US008984778B2

(12) United States Patent
Fox et al.

(10) Patent No.: US 8,984,778 B2
(45) Date of Patent: Mar. 24, 2015

(54) PLOW BLADE AND METHOD

(71) Applicant: Ironhawk Industrial Distribution LLC, Beachwood, OH (US)

(72) Inventors: Eric Fox, Sligo, PA (US); Ron Abramczyk, Willowick, OH (US)

(73) Assignee: Ironhawk Industrial Distribution LLC, Beachwood, OH (US)

( * ) Notice: Subject to any disclaimer, the term of this patent is extended or adjusted under 35 U.S.C. 154(b) by 42 days.

(21) Appl. No.: 13/832,656

(22) Filed: Mar. 15, 2013

(65) Prior Publication Data

US 2014/0259805 A1 Sep. 18, 2014

(51) Int. Cl.
*E01H 5/06* (2006.01)

(52) U.S. Cl.
CPC ..... *E01H 5/062* (2013.01)
USPC ..... 37/266

(58) Field of Classification Search
USPC ..... 37/232, 266, 270, 407
See application file for complete search history.

(56) References Cited

U.S. PATENT DOCUMENTS

| | | | | |
|---|---|---|---|---|
| 2,061,585 | A | 11/1936 | Meyer | |
| 3,413,738 | A | 12/1968 | Goldberg | |
| 3,465,456 | A | 9/1969 | Meyer | |
| 3,477,149 | A | 11/1969 | Wagner | |
| 4,288,932 | A | 9/1981 | Kuper | |
| 4,347,677 | A | 9/1982 | Kuper | |
| 4,590,694 | A | 5/1986 | Block | |
| 4,667,943 | A | 5/1987 | Izumi et al. | |
| 5,471,770 | A | 12/1995 | Ferreira | |
| 5,743,032 | A * | 4/1998 | Vauhkonen | 37/446 |
| 5,746,017 | A | 5/1998 | Marvik | |
| 6,751,894 | B2 * | 6/2004 | Verseef | 37/266 |
| 6,922,924 | B2 | 8/2005 | Jones et al. | |
| 7,107,709 | B2 | 9/2006 | Hamel | |
| 7,467,485 | B2 | 12/2008 | Hamel | |
| 7,631,441 | B2 | 12/2009 | Hunt | |
| 7,765,726 | B2 | 8/2010 | Kuper | |
| 7,874,085 | B1 | 1/2011 | Winter et al. | |
| 7,905,035 | B2 | 3/2011 | Thomas | |
| 8,191,287 | B2 * | 6/2012 | Winter et al. | 37/266 |
| 2012/0260537 | A1 * | 10/2012 | Winter et al. | 37/270 |
| 2013/0174452 | A1 * | 7/2013 | Diehl et al. | 37/233 |

FOREIGN PATENT DOCUMENTS

| | | |
|---|---|---|
| DE | 2400440 | 7/1975 |
| DE | 3319223 | 7/1984 |
| DE | 3404030 | 7/1985 |
| DE | 3814240 | 11/1989 |
| DE | 19643847 | 5/1998 |

(Continued)

*Primary Examiner* — Gary Hartmann
(74) *Attorney, Agent, or Firm* — Calfee, Halter & Griswold LLP

(57) ABSTRACT

The present application discloses a plow blade that may be mounted to a plow moldboard. In one exemplary embodiment, the plow blade comprises one or more blade segments, an elastomeric portion that at least partially surrounds the one or more blade segments and permits the one or more blade segments to move relative to the moldboard, and one or more bushings disposed in the elastomeric portion for attaching the plow blade to the moldboard. The one or more blade segments are generally shaped and positioned within the elastomeric portion such that a portion of each blade segment is disposed between at least one bushing and a top edge of the plow blade.

30 Claims, 8 Drawing Sheets

(56) References Cited

FOREIGN PATENT DOCUMENTS

| | | |
|---|---|---|
| DE | 102005040705 | 3/2007 |
| EP | 1731676 | 12/2006 |
| SE | 454279 | 4/1988 |
| WO | 2005124031 | 12/2005 |
| WO | 2007131663 | 11/2007 |

* cited by examiner

PLOW BLADE AND METHOD

BACKGROUND

Plowing vehicles, such as snowplowing vehicles, generally have a curved, shovel like device commonly known as a moldboard disposed on the front, side underneath, and/or rear of the vehicle. A plow blade is generally removably attached to a lower portion of the moldboard. The plow blade acts as the cutting edge by scraping along the upper surface of a roadway to remove snow or other materials from the roadway. As such, the plow blade often wears quickly and requires replacement. Further, certain segments of the plow blade may wear more quickly than others due to various factors beyond the control of a plow vehicle operator such as uneven or crowned roadways or the plow blade striking objects in or on the roadway.

SUMMARY

The present application discloses a plow, a plow blade for mounting to a plow moldboard, and methods of installing a plow blade to a plow moldboard. In certain embodiments, the plow comprises a moldboard, an adapter blade attached to the moldboard, and a plow blade removably attached to the adapter blade. In one exemplary embodiment, the plow blade comprises one or more blade segments; an elastomeric portion that at least partially surrounds the one or more blade segments and permits the one or more blade segments to move relative to the moldboard; and one or more bushings disposed in the elastomeric portion for attaching the plow blade to the adapter blade and/or the moldboard. The one or more blade segments are generally shaped and positioned within the elastomeric portion such that a portion of each blade segment is disposed between at least one bushing and a top edge of the plow blade. These and additional embodiments will become apparent in the course of the following detailed description.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of the inventions.

DESCRIPTION OF EMBODIMENTS

The present application discloses a plow blade having blade edge segments encased in an elastomeric material that permits the blade segments to move independently relative to the moldboard of the plow. The elastomeric material permits the blade edge segments to adjust to various irregularities in the roadway. As such, the plow blade edge is capable of conforming to the road surface and/or objects in or on the road surface, such as road markers. Further, the elastomeric material reduces or suppresses the forces experienced by the blade edge segments and at least partially absorbs the noise, shock, and vibration from the blade edge. As a result, the amount of wear (e.g., uneven wear) and damage to the blade edge segments is reduced and the useful life of the plow blade is increased.

The plow blade of the present application is intended to be universal in that it may be configured for use with any (or most) plowing systems. For example, the plow blade may be used with front plows, underbody plows, wing plows, or tow plows. Exemplary front plow configurations include bottom trip, trip plow, one-way, section trip, slide trip, V-plow, or folding V-plow configurations ranging from 8 to 32 feet in blade length. Exemplary underbody plow configurations include high speed hinged, folding moldboard, fixed, or reversible configurations ranging from 9 to 14 feet in blade length. Exemplary wing plow configurations include patrol wing, benching leveling wing, mid mount wing, front mount wing, extendable mid mount wing, or rear mount wing configurations ranging from 6 to 14 feet in blade length. The plow blade may also be used with a variety of tow plow configurations ranging from 5 to 32 feet in blade length.

A plow of the present application generally comprises a moldboard, and adapter blade attached to the moldboard, and a plow blade removably attached to the adapter blade. However, in certain embodiments, various other members may be used to attach the plow blade to the moldboard or the plow blade of the present application may be attached directly to the moldboard.

Figure 1A:
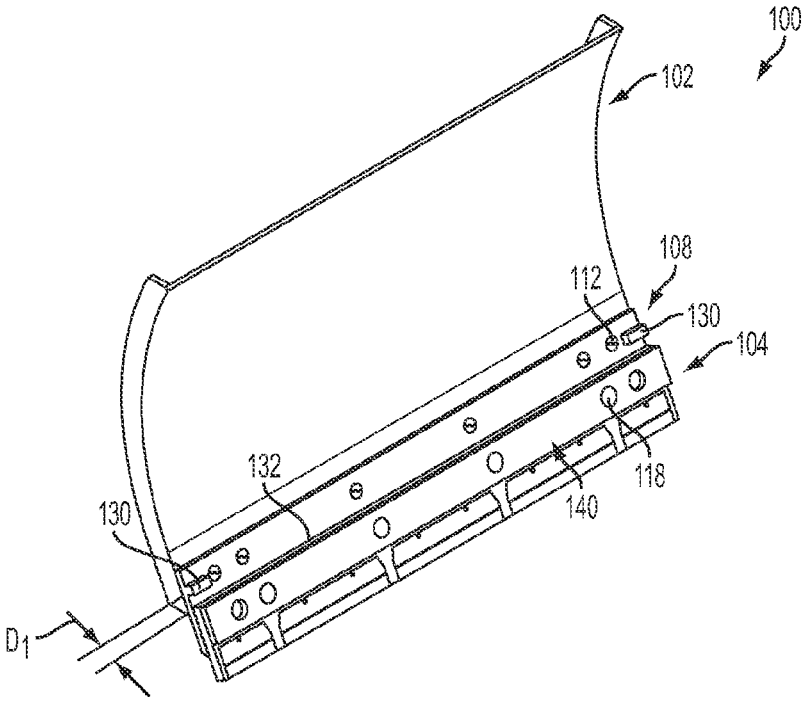
FIG. 1A is a perspective view of a plow according to an embodiment of the present application.
Figure 1B:
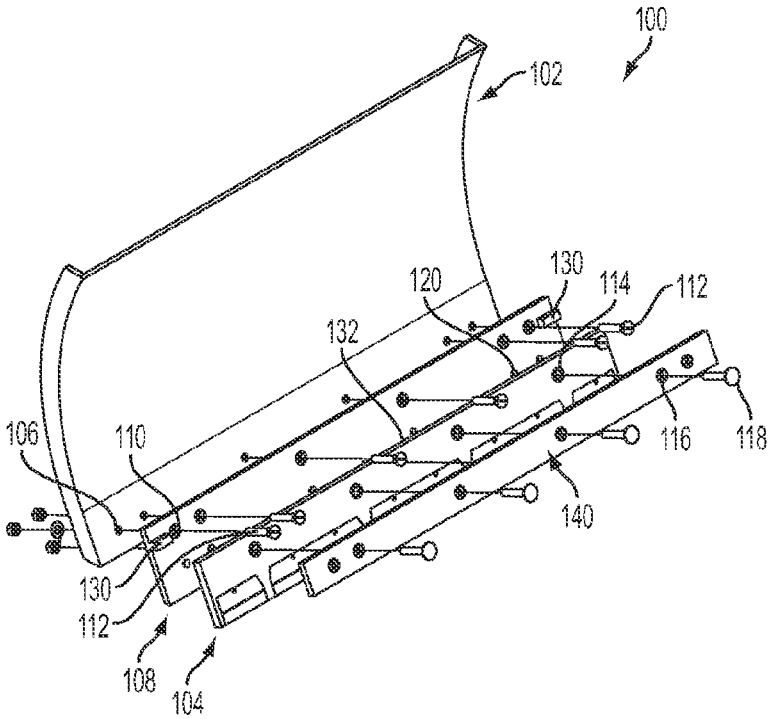
FIG. 1B is an exploded perspective view of the plow of FIG. 1A illustrating assembly of the plow.

FIGS. 1A and 1B illustrate an exemplary plow 100 according to an embodiment of the present application. The plow 100 comprises a moldboard 102 and a plow blade 104 removably attached to the moldboard. As shown, the moldboard 102 includes a curved, concave portion for directing snow or other material up and away from the roadway. A lower portion of the moldboard 102 includes spaced openings 106 for attachment of the plow blade 104 to the moldboard. In certain embodiments, the spaced openings 106 of the moldboard 102 are disposed in a separate member attached to a lower edge of the curved portion.

As illustrated in FIGS. 1A and 1B, an adapter blade 108 is used to attach the plow blade 104 to the moldboard 102. As shown, the adapter blade 108 comprises spaced openings 110 that substantially align with the spaced openings 106 in the moldboard 102 and fasteners 112 are used to removably attach the adapter blade to the moldboard. The layout of the spaced openings 106 in the moldboard 102 and the spaced openings 110 in the adapter blade 108 (i.e., punch layout) shown in the Figures is commonly referred to as a 3"-3"-12" layout. However, it should be noted that the adapter blade 108 configurations shown in FIGS. 1A and 1B are merely exemplary and the adapter blade may be configured for use with a variety of punch layouts, including 2"-8"-8", 4"-8"-8", or any other layout to fit any plow configuration.

As illustrated in FIGS. 1A and 1B, the plow blade 104 comprises spaced openings 114 that substantially align with spaced openings 120 of the adapter blade 108. The layout of the spaced openings 114 in the plow blade 104 and the spaced openings 120 in the adapter blade shown in the Figures is commonly referred to as a 6"-12"-12"-12" layout. However, it should be noted that the plow blade 104 and adapter blade 108 configurations shown in FIGS. 1A and 1B are merely exemplary and the plow blade may be configured for use with a variety of punch layouts, including 6"-12"-12", 3"-3"-12", 2"-8"-8", 4"-8"-8", or any other layout to fit any plow configuration. Further, a mounting member 140 comprises spaced openings 116 extending through an elongate member of the mounting member. When the plow blade 104 is mounted to the adapter blade 108, fasteners 118 are inserted through the spaced openings 116 in the mounting member 140, the spaced openings 114 in the plow blade 104, and the spaced openings 120 in the adapter blade 108 to removably attach the plow blade to the adapter blade.

As illustrated in FIGS. 1A and 1B, threaded bolts (e.g., carriage bolts), washers and nuts are used to fasten the plow blade 104 to the adapter blade 108 and the adapter blade to the moldboard 102. However, a variety of other suitable fasteners may be used, such as for example, pins, studs, posts, or the like. For example, in one embodiment, the mounting member 140 comprises posts or studs (e.g., threaded posts or studs) extending from a longitudinal surface of the elongate member. In this embodiment, it is contemplated that one end of the posts or studs may be welded or otherwise affixed to the mounting member 140. The projecting end of the posts or studs is inserted through the spaced openings 114 in the plow blade 104 and the spaced openings 120 in the adapter blade 108 to attach the plow blade to the adapter blade. A nut may be used with each post or stud to fasten the plow blade 104 to the adapter blade 108.

The adapter blade 108 shown in FIGS. 1A and 1B comprises one or more stops 130 extending outward from the face of the adapter blade and positioned above the plow blade 104. The stops 130 may be integrally formed with the adapter blade 108 or attached to the adapter blade in a variety ways, such as with fasteners or a weld. If the plow blade 104 is forced or otherwise moved upward relative to the adapter blade 108 a certain distance, the top edge 132 of the plow blade 104 contacts the one or more of the stops 130 to prohibit any further upward movement of the plow blade relative to adapter blade. As such, the stops 130 prohibit over travel of the blade segments and over compression of the elastomeric material that may damage the plow blade 104. As shown in FIG. 1A, the stops 130 are positioned a distance $D_1$ above the top edge 132 of the plow blade 104. The distance $D_1$ is generally between about ½ inch and about 1½ inch. In certain embodiments, the distance $D_1$ is about 1 inch.

Further, the adapter blade 108 acts as a secondary or backup blade for the plow 100. For example, should the plow blade 104 become damaged (e.g., one or more blade segments are removed) and/or is worn down, the cutting edge of the adapter blade 108 is exposed and will scrape along the roadway to remove snow or other materials from the roadway.

As illustrated in FIGS. 1A and 1B, the plow blade 100 is formed as a single elongate member positioned between the adapter blade 108 and the mounting member 140. However, in other embodiments, the plow blade 100 is formed from a plurality of components positioned between the adapter blade 108 and the mounting member 140. For example, the plow blade 100 may be divided into a plurality of segments (e.g., 6, 10 or 12 inch segments) that are positioned end to end along the length of the adapter blade 108 or moldboard 102. These segments may or may not be sized to the length of the individual blade segments. Further, gaps may exist between two or more plow blade segments such that the plow blade is not contiguous. Further still, two or more of the plow blade segments may be removably attached together, such as for example, with a tongue/groove connection, male/female connection, straps, buckles, pins, screws, bolts, Velcro®, or other fastener. Further, one or more plow blade segments may comprise male and/or female parts to facilitate proper alignment of the plow blade with the adapter blade 108.

One exemplary method of installing a plow blade to a plow moldboard includes utilizing an adapter blade having one or more first openings and one or more second openings. The one or more first openings of the adapter blade are aligned with one or more openings of a moldboard. One or more first fasteners are inserted through the one or more first openings of the adapter blade and the one or more openings in the moldboard to attach the adapter blade to the moldboard. Further, a plow blade is utilized comprising one or more blade segments; an elastomeric portion that at least partially surrounds the one or more blade segments and permits the one or more blade segments to move relative to the moldboard when the plow blade is attached to the adapter blade; and one or more bushings disposed in the elastomeric portion for attaching the plow blade to the adapter blade. The one or more blade segments are shaped and positioned within the elastomeric portion such that a portion of each blade segment is disposed between at least one bushing and a top edge of the plow blade. The one or more bushings of the plow blade are aligned with the one or more second openings of the adapter blade. One or more second fasteners are inserted through the one or more bushings of the plow blade and the one or more second openings of the adapter blade to attach the plow blade to the adapter blade. In certain embodiments, one or more openings of a mounting member are aligned with the one or more bushings of the plow blade and the one or more second fasteners are inserted through the one or more openings of the mounting member.

The plow blade of the present application generally comprises at least one blade segment, an elastomeric portion that at least partially surrounds the at least one blade segment, and at least one insert or bushing disposed in the elastomeric portion and having an opening for directly or indirectly mounting the plow blade to a moldboard. The elastomeric portion permits the blade segment to move relative to the moldboard when the plow blade is mounted to the moldboard.

The blade segments of the present application are generally shaped and positioned within the elastomeric portion such that at least a portion of the blade segment is disposed between a bushing and a top edge of the plow blade. In certain embodiments, the blade segments are also shaped and positioned within the elastomeric portion such that at least a portion of the blade segment is disposed between the bushing and a bottom edge of the plow blade. As such, the blade segments will interfere with the bushings should the blade segments move upward and/or downward a certain distance relative to the bushings. As a result, should a blade segment or a section of the plow blade that includes a blade segment become dislodged or removed from the elastomeric portion or the remainder of the plow blade, the blade segment or section will catch on the bushing such that it is not deposited on the roadway. This may occur, for example, if a portion of the plow blade (e.g., the elastomeric portion) is cut, ripped or otherwise damaged during use of the plow blade. Further, the bushings act as stops that prohibit over travel of the blade segments and over compression of the elastomeric material that may damage the plow blade.

FIGS. 2A-2D illustrate a plow blade 200 according to an embodiment the present application. The plow blade 200 comprises three center blade segments 204 and two end blade segments 202A and 202B encased in an elastomeric material 206. Also encased in the elastomeric material 206 are four inserts or bushings 208 with openings for mounting the plow blade 200 directly or indirectly to a moldboard. Further, the elastomeric material 206 holds the blade segments 202A, 202B, and 204 in position and permits the blade segments to move independently relative to the moldboard of the plow, as described above.

Figure 3:
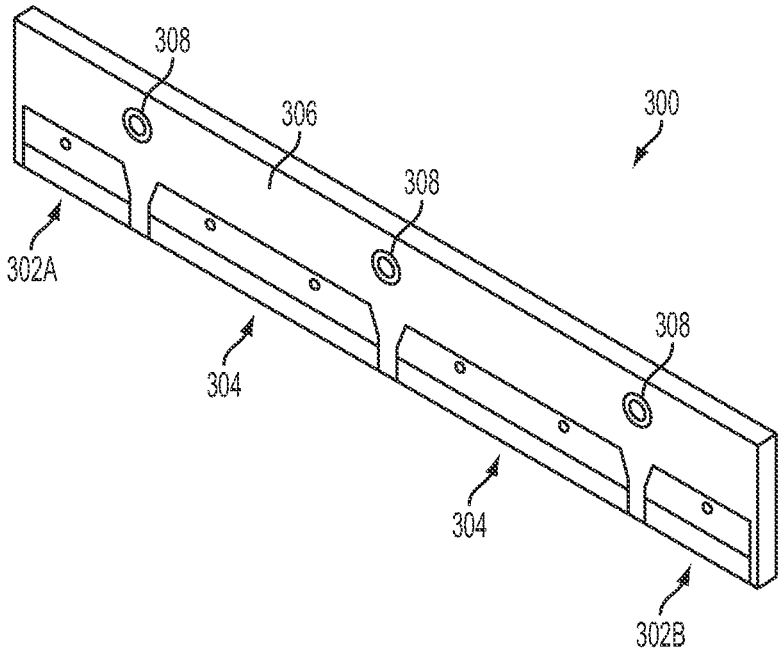
FIG. 3 is a front perspective view of a plow blade according to an embodiment of the present application.

In certain embodiments, the plow blade 200 is about four feet in length and the spaced bushing openings have a 6"-12"-12"-12" layout. However, the plow blade of the present application may be sized and configured in a variety of ways to fit various plows or portions of a plow. For example, the plow blade 300 illustrated in FIG. 3 comprises two center blade segments 304 and two end blade segments 302A and 302B encased in an elastomeric material 306. Further, three inserts or bushings 308 with openings for mounting the plow blade 300 to a moldboard are encased in the elastomeric material 306. In certain embodiments, the plow blade 300 is about three feet in length and the spaced bushing openings have a 6"-12"-12" layout.

Figure 4:
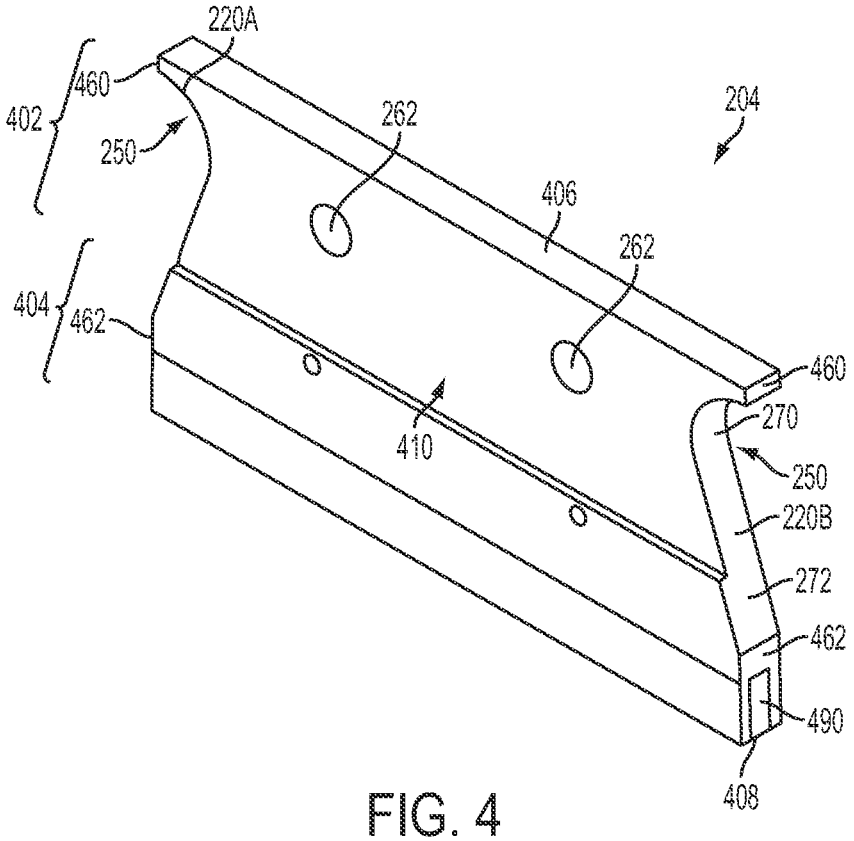
FIG. 4 is a front perspective view of a blade segment according to an embodiment of the present application.

As illustrated in FIGS. 2A-2D and 4, the elastomeric material 206 encases the right and left vertical sides 220A and 220B, top edge 406, rear face, and a top portion 402 of the front face 410 of each center blade segment 204 to hold the blade segments in position and permit the blade segments to move independently relative to the moldboard of the plow. The bottom edge 408 and a bottom portion 404 of the front face 410 of each center blade segment 204 is exposed and not encased by the elastomeric material 206. As such, the cutting edge of each center blade segment 204 is visible such that the amount of damage and/or wear to the blade segment may be assessed. Further, as illustrated in FIG. 4, the top portion 402 of the front face 410 of each center blade segment 204 is recessed relative to the bottom portion 404 of the front face. As such, the elastomeric material 206 covering the front face 410 of the center blade segments 204 forms a substantially smooth transition with the exposed portions of the blade segments to prohibit materials from catching on the front face of the plow blade.

Figure 2D:
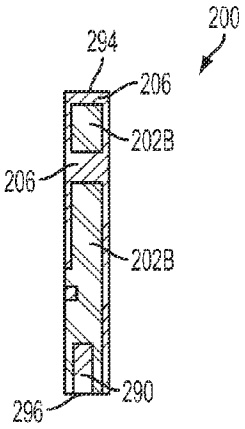
FIG. 2D is a cross sectional view of the plow blade of FIG. 2A taken along line 2D-2D shown in FIG. 2B.
Figure 5A:
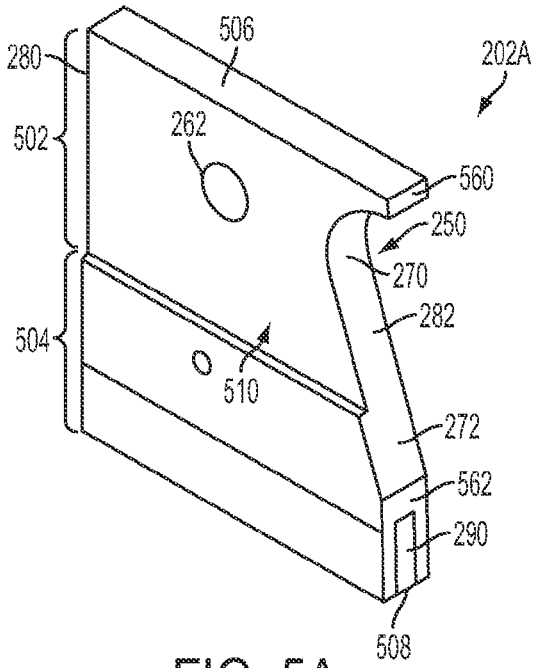
FIGS. 5A and 5B are front perspective views of blade segments according to embodiments of the present application.
Figure 5B:
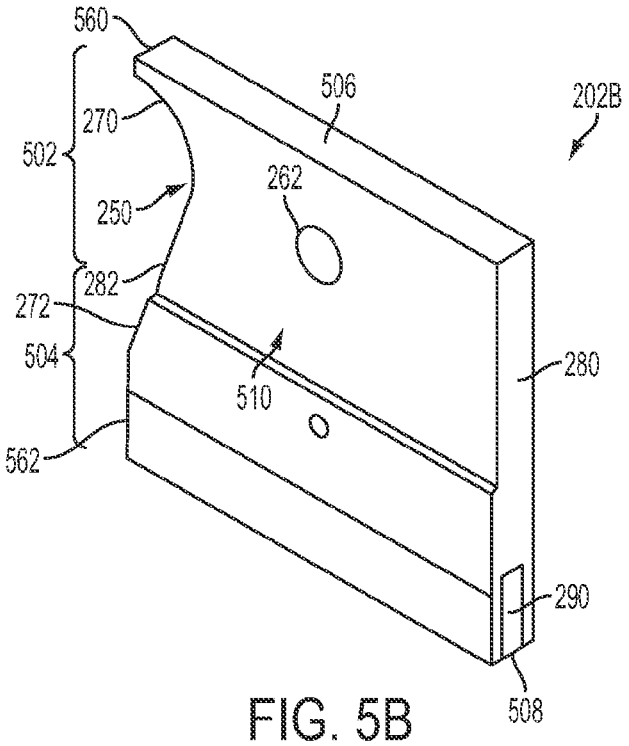

FIGS. 5A and 5B illustrate the right and left end blade segments 202A and 202B, respectively. As shown, the right and left end blade segments 202A and 202B are mirror images of each other. As illustrated in FIGS. 2A-2D, 5A and 5B, the elastomeric material 206 encases the vertical sides 280 and 282, top edge 506, rear face, and a top portion 502 of the front face 510 of each end blade segment 202A and 202B to hold the blade segments in position and permit the blade segments to move independently relative to the moldboard of the plow. The bottom edge 508 and a bottom portion 504 of the front face 510 of each end blade segment 202A and 202B is exposed and not encased by the elastomeric material 206. As such, the cutting edge of each end blade segment 202A and 202B is visible such that the amount of damage and/or wear to the blade segment may be assessed. Further, as illustrated in FIGS. 2D, 5A and 5B, the top portion 502 of the front face 510 of each end blade segment 202A and 202B is recessed relative to the bottom portion 504 of the front face. As such, the elastomeric material 206 covering the front face 510 of the end blade segments 202A and 202B forms a substantially smooth transition with the exposed portions of the blade segments to prohibit materials from catching on the front face of the plow blade.

Figure 2C:
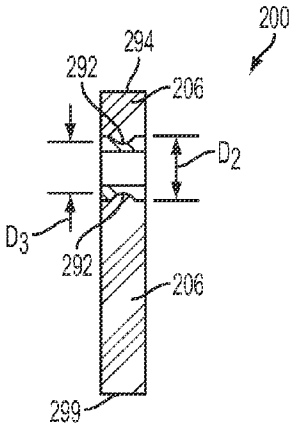
FIG. 2C is a cross sectional view of the plow blade of FIG. 2A taken along line 2C-2C shown in FIG. 2B.
Figure 2A:
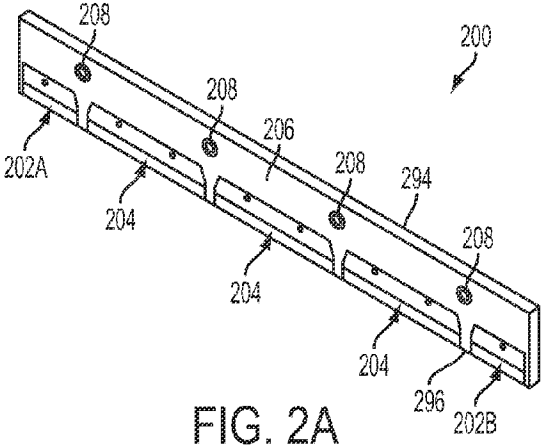
FIG. 2A is a front perspective view of a plow blade according to an embodiment of the present application.
Figure 8:
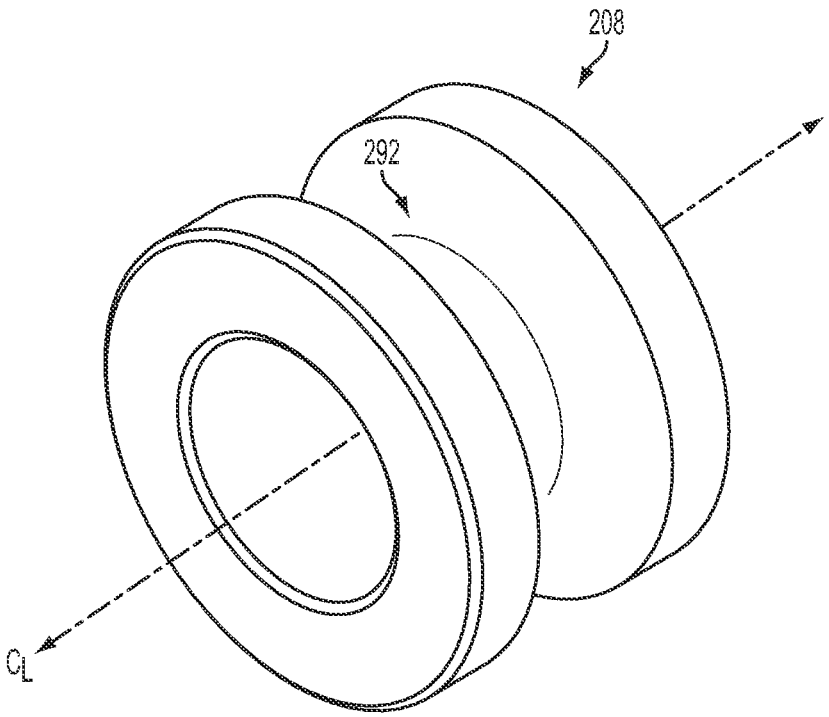
FIG. 8 is a perspective view of a bushing according to an embodiment of the present application.

As illustrated in FIGS. 2C and 8, the bushings 208 of the plow blade 200 comprise a reduced outer diameter or recessed portion 292 between the ends of the bushing. As shown in FIG. 2C, the elastomeric material 206 is disposed within the recessed portion 292 of the bushing 208 to hold the bushing in position and secured within the elastomeric material. The outer diameter $D_2$ of the bushings 208 is between about 1 inch and about 2 inches and the diameter $D_3$ of the recessed portion 292 is between about ⅞ inch and about 1½ inches. In certain embodiments, the outer diameter $D_2$ is about 1¼ inches and the diameter $D_3$ of the recessed portion 292 is about 31/32 inch. In certain embodiments, the inner diameter of the bushing 208 (or diameter of the opening) is about 11/16 inch and the center of the bushing is about 1½ inch from a top edge 294 of the plow blade 200. In certain embodiments, the outer surface of one or more of the bushings 208 may be square, rectangular, oval, hexagonal, triangular, or any other shape.

Figure 2B:
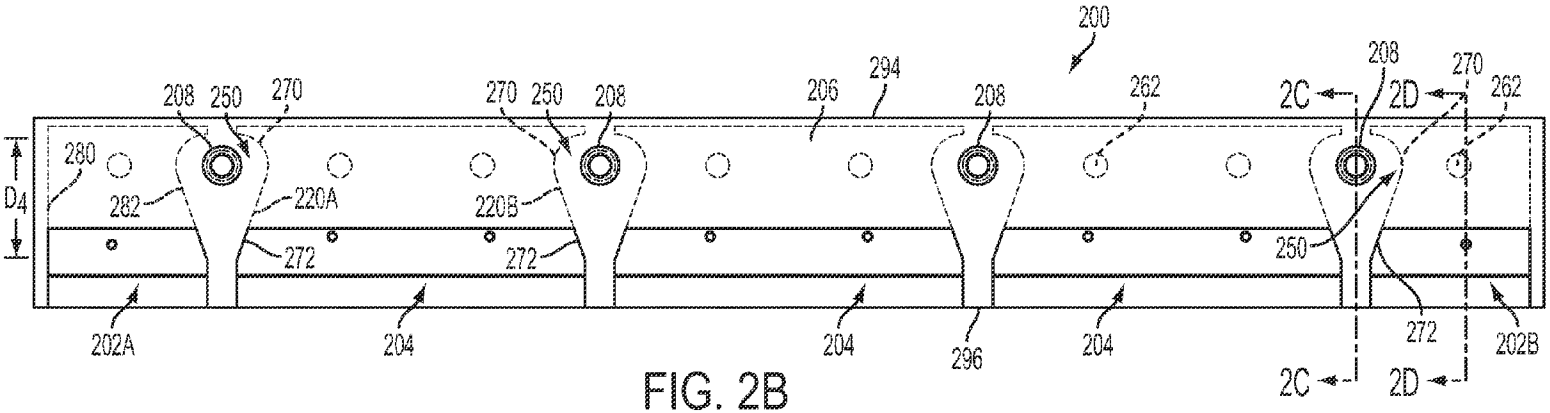
FIG. 2B is a front view of the plow blade of FIG. 2A.

Further, as illustrated in FIGS. 2B, 2D, and 4-5B, each of the blade segments 202A, 202B, and 204 comprise at least one opening 262 in the top portion 402, 502 of the blade segment. As shown in FIGS. 2B and 2D. The elastomeric material 206 is disposed within the opening 262 of the blade segments 202A, 202B, and 204 to hold the blade segment in position and secured within the elastomeric material. The diameter of the opening 262 is between about ½ inch and about 1½ inch. In certain embodiments, the diameter of the opening 262 is about ¾ inch.

As illustrated in FIGS. 2B and 4-5B, at least one vertical side or edge 220A, 220B, and 282 of each blade segment 202A, 202B, and 204 extends inward toward the center of the blade segment to form a recessed portion 250. The recessed portions 250 at least partially surround the bushings 208 of the plow blade 200 and are shaped such that a first section 270 of the recessed portion is positioned between the bushing and the top edge 294 of the plow blade and a second section 272 of the recessed portion is positioned between the bushing and a bottom edge 296 of the plow blade. As such, the first and second sections 270 and 272 of the recessed portions 250 interfere with the bushings 208 when the blade segments 202A, 202B, and 204 move upward and/or downward a certain distance relative to the bushings.

The center blade segments 204 illustrated in FIGS. 2B and 4 comprise recessed portions 250 on both the right and left vertical sides 220A and 220B of the blade segment. As shown, the recessed portions 250 are mirror images of each other about the vertical centerline of the blade segment 204. However, in other embodiments, the center blade segment 204 may or may not comprise recessed portions on both the right and left vertical sides and/or the recessed portions may or may not be mirror images. Further, the right and left end blade segments 202A and 202B illustrated in FIGS. 5A and 5B, respectively, comprise a recessed portion 250 on the interior vertical side 282 of the blade segment. As illustrated in FIG. 2B, the recessed portions 250 of the center and end blade segments 202A, 202B, and 204 are the same size and shape. However, in other embodiments, the recessed portions of the center and end blade segments are not the same size and/or shape.

The recessed portions of the blade segments may be a variety of sizes and shapes. For example, the recessed portions may comprise one or more curved, arcuate, or straight edges forming a variety of shapes, including, but not limited to, circular, rectangular, oval, elliptical, square, triangular, and hour glass shapes. In certain embodiments, the blade segments may be positioned within the elastomeric material such that the recessed portions of adjacent blade segments collectively substantially surround one or more of the bushings. Further, one or more of the recessed portions may be configured such that only the first section is positioned between the bushing and the top edge of the plow blade, only the second section is positioned between the bushing and the bottom edge of the plow blade, or both. The recessed portions may also be sized and shaped to permit certain amounts of vertical, horizontal and rotational movement of the blade segments relative to the bushings.

As illustrated FIGS. 2B and 4-5B, the first section 270 of the recessed portions 250 of the center and end blade segments 202A, 202B, and 204 is curved and the second section 272 is straight. Further, the portion of the vertical side 220A, 220B, and 282 extending between the first section 270 of the recessed portion 250 and the top edge 406 and 506 of the blade segments 202A, 202B, and 204 forms a protruding end 460 and 560 that is disposed between the bushing 208 and the top edge 294 of the plow blade 200. Similarly, the portion of the vertical side 220A, 220B, and 282 extending between the second section 272 of the recessed portion 250 and the bottom edge 296 of the blade segment 202A, 202B, and 204 forms a protruding side 462 and 562 that is disposed between the bushing 208 and the bottom edge 296 of the plow blade 200. As illustrated in FIG. 2B, the vertical length $D_4$ of the recessed portion 250 is generally between about 3 inches and about 3½ inches. In certain embodiments, the vertical length $D_4$ is about 3¼ inches. Further, the radius of the curved first section 270 is generally between about ¾ inch and about 1¼ inches. In certain embodiments, the radius of the curved first section 270 is about 1 inch.

The recessed portions 250 permit the blade segments 202A, 202B, and 204 to move vertically downward relative to the bushings 208 (from the neutral position shown in FIG. 2B) between about ⅜ inch and about ⅝ inch before the first section 270 contacts the bushing. Further, the recessed portions 250 permit the blade segments 202A, 202B, and 204 to move vertically upward relative to the bushings 208 (from the neutral position shown in FIG. 2B) between about 1 inch and about 1¾ inches before the second section 272 contacts the bushing. In certain embodiments, the permitted downward movement of the blade segments 202A, 202B, and 204 is about ½ inch and the permitted upward movement is about 1½ inches. As a result, should a blade segment 202A, 202B, and 204 or a section of the plow blade 200 that includes a blade segment become dislodged or removed from the elastomeric portion 206 or the remainder of the plow blade, the blade segment or section will only move upward or downward by these amounts before the blade segment catches on the bushing. Further, the bushings 208 act as stops that prohibit travel of the blade segment 202A, 202B, and 204 beyond these amounts and over compression of the elastomeric material 206 that may damage the plow blade 200.

Figure 6:
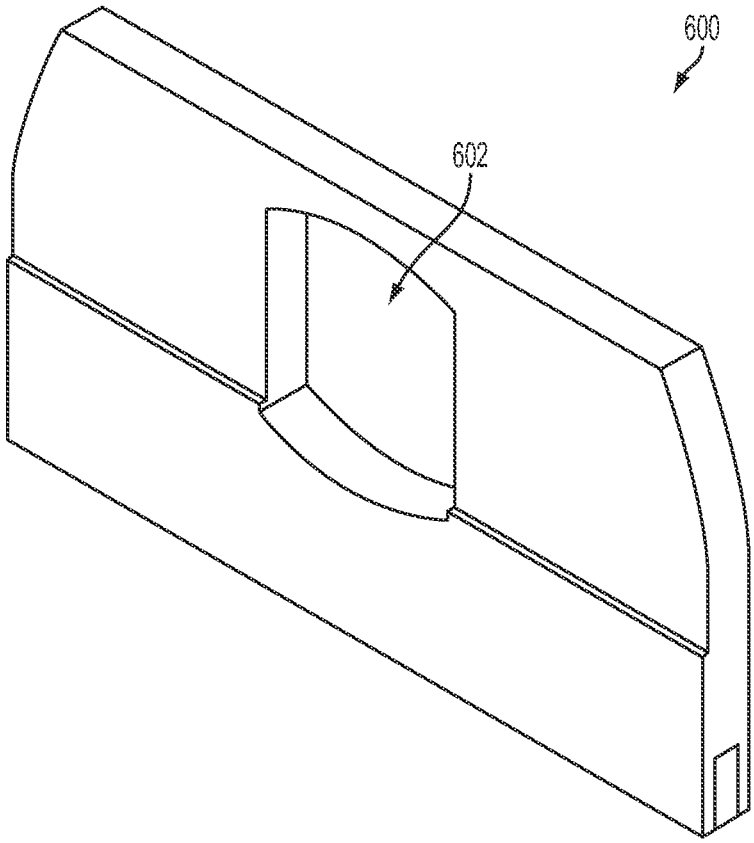
FIG. 6 is a front perspective view of a blade segment according to an embodiment of the present application.

FIG. 6 illustrates a blade segment 600 according to an embodiment of the present application. As shown, the blade segment 600 comprises a central opening 602. In certain embodiments, the blade segment 600 is positioned within the elastomeric material of the plow blade such that the opening 602 surrounds a bushing of the plow blade. As such, the sides of the opening 602, including the top and bottom portions of the opening, will interfere with the bushing should the blade segment 600 move upward and/or downward a certain distance relative to the bushing.

Figure 7:
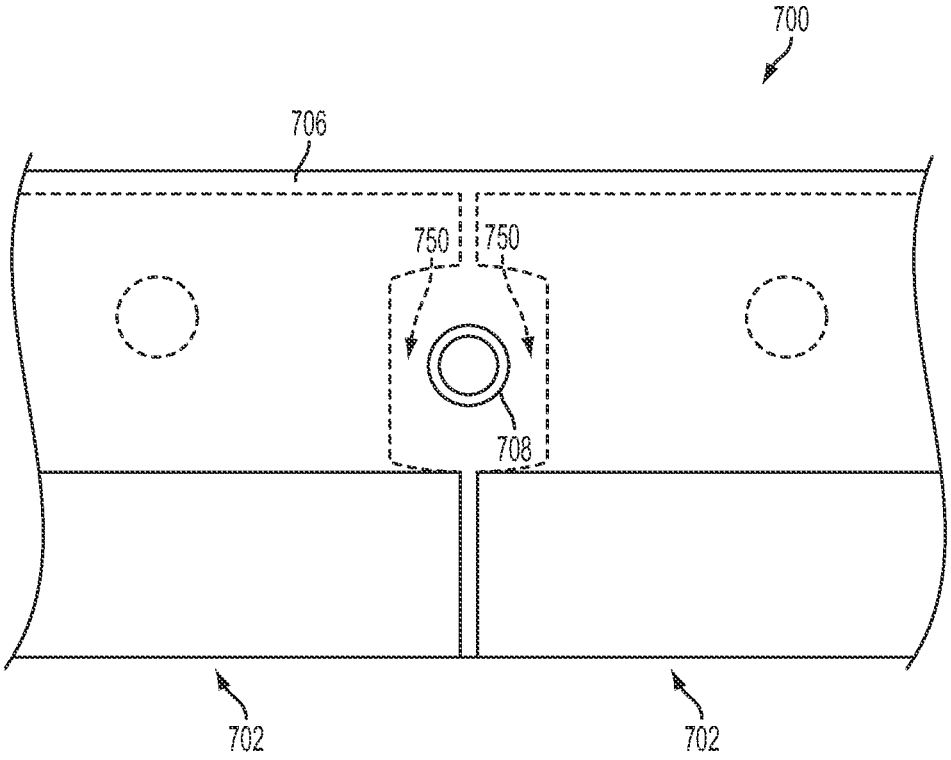
FIG. 7 is a partial front view of a plow blade according to an embodiment of the present application.

FIG. 7 illustrates a plow blade 700 according to an embodiment of the present application. As shown, the plow blade 700 comprises adjacent blade segments 702 encased in an elastomeric material 706. The vertical side of each blade segment 702 comprises a recessed portion 750. As shown, the blade segments 702 are positioned within the elastomeric material 706 such that the recessed portions 750 collectively substantially surround the bushing 708. As such, the top and bottom portions of the recessed portions 750 will interfere with the bushing should the blade segments 702 move upward and/or downward a certain distance relative to the bushing 708.

The blade segments of the present application are generally constructed of steel. In certain embodiments, the end blade segments are about ¾ inch thick, about 5¾ inch wide, and about 5 inches long and the center blade segments are about ¾ inch thick, about 5¾ inch wide, and about 11 inches long.

One or more of the blade segments may have a milled groove in the bottom edge for an insert that is generally made of a harder material than the blade segment. For example, FIGS. 2D, 5A and 5B illustrate the insert 290 disposed in a groove in the bottom edge 508 of the end blade segments 202A and 202B. Further, FIG. 4 illustrates the insert 490 disposed in a groove in the bottom edge 408 of the center blade segments 204. In certain embodiments, the insert is constructed of tungsten carbide or functional equivalents, such as WC grade tungsten carbide grade K3030C. Certain tungsten carbide inserts have a cobalt content between about 11 and 12.5%, a density between about 14.1 minimum and 14.6 maximum, a hardness between about 87.5 and 89 Rockwell A, and a transverse rupture strength of about 350,000 psi. Brazing may or may not be used to secure the insert in the milled groove of the blade segment.

The elastomeric material of the present application may be a variety of materials capable of holding the blade segments in position and permitting the blade segments to move independently relative to the moldboard of the plow. Exemplary materials include, but are not limited to, rubber, plastic or polyurethane materials that do not corrode in the presence of salt and water and are compatible with steel. Further, the properties of the elastomeric material and the overall thickness of the plow blade may vary between embodiments and/or be tuned to a specific plow, moldboard, or plow blade edge. For example, the hardness, stiffness, thickness, and/or density of the elastomeric material may vary based on the size, type, and/or configuration of the plow, moldboard, or plow blade edge.

In certain embodiments, the elastomeric material comprises a polyurethane material having a hardness between about 75 and 96 Durometer A and a density between about 1038 and 1235 kg/m$^3$. In one particular embodiment, the elastomeric material comprises a polyurethane material having a hardness of about 85 Durometer A and a density of about 1163 kg/m$^3$. Further, the polyurethane material may have an ultimate elongation of about 650%, a secant modulus of about 300% at 900 psi, a tensile strength of about 5500 psi, a tear strength (die C) of about 400 pli, a compression set of about 35%, and a bayshore rebound of about 30%.

In certain embodiments, the elastomeric material comprises a rubber compound having a hardness between about 50 and 80 Durometer A and a density between about 1107 and 1301 kg/m$^3$. In one particular embodiment, the elastomeric material comprises a rubber compound having a hardness of about 67 Durometer A and a density of about 1160 kg/m$^3$.

The elastomeric material of the present application may also comprise one or more materials joined or otherwise secured together to form the plow blade. For example, one or more portions of the elastomeric material may comprise a first material that is different than a second material found in one or more other portions of the elastomeric material. The type, hardness, stiffness, thickness, and/or density of the first material may be different than the second material. Different types of materials include, for example, various types of polyurethane, rubber or plastic.

The bushings of the of the present application may be constructed of a variety materials such as, for example, steel, powdered metal, plastic or urethane. For example, in certain embodiments, the bushings are constructed of steel or powdered metal. Further, the overall size of the plow blade may vary depending on the plow or plowing system. For example, in certain embodiments, the plow blade is about ⅞ inch thick, about 6 inches wide, and about 3 feet long. In other embodiments, the plow blade is about ⅞ inch thick, about 6 inches wide, and about 4 feet long.

The words used in the claims have their full ordinary meaning and are not limited in any way by the description of the embodiments in the specification. Further, as described herein, when one or more components are described as being connected, joined, affixed, coupled, attached, or otherwise interconnected, such interconnection may be direct as between the components or may be in direct such as through the use of one or more intermediary components. Also as described herein, reference to a "member," "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasably or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A plow blade for mounting to a plow moldboard, comprising:

one or more blade segments;

an elastomeric portion that at least partially surrounds the one or more blade segments and permits the one or more blade segments to move relative to the moldboard when the plow blade is mounted to the moldboard; and one or more bushings disposed in the elastomeric portion for mounting the plow blade to the moldboard; and wherein the one or more blade segments are shaped and positioned within the elastomeric portion such that at least one vertical side of each blade segment comprises a recessed portion that at least partially surrounds at least one bushing of the plow blade.

2. The plow blade of claim 1, wherein the one or more blade segments are shaped and positioned within the elastomeric portion such that a portion of each blade segment is disposed between at least one bushing and a top edge of the plow blade and a lower portion of each blade segment is disposed between at least one bushing and a bottom edge of the plow blade.

3. The plow blade of claim 2, wherein the portion of each blade segment contacts at least one bushing if the blade segment moves downward a certain distance.

4. The plow blade of claim 1, wherein the recessed portion comprises a first section that is at least partially positioned between the bushing and the top edge of the plow blade.

5. The plow blade of claim 4, wherein the first section is curved.

6. The plow blade of claim 4, wherein the recessed portion comprises a second section that is at least partially positioned between the bushing and a bottom edge of the plow blade.

7. The plow blade of claim 1, wherein the recessed portion is at least partially curved.

8. The plow blade of claim 1, wherein the recessed portion forms a protruding end of the blade segment that is disposed between the bushing and the top edge of the plow blade.

9. The plow blade of claim 1, wherein the one or more blade segments comprises a pair of adjacent blade segments, and wherein at least one vertical side of each adjacent blade segment comprises a recessed portion that at least partially surrounds at least one bushing of the plow blade.

10. The plow blade of claim 9, wherein the recessed portions of the adjacent blade segments collectively substantially surround the bushing.

11. The plow blade of claim 1, wherein the one or more blade segments comprises at least one center blade segment and at least two end blade segments.

12. The plow blade of claim 11, wherein at least two vertical sides of each center blade segment comprise a recessed portion that at least partially surrounds at least one bushing of the plow blade.

13. The plow blade of claim 12, wherein at least one vertical side of each end blade segment comprises a recessed portion that at least partially surrounds at least one bushing of the plow blade.

14. The plow blade of claim 11, wherein the elastomeric portion encases right and left vertical sides, a top edge, a rear face, and a top portion of a front face of each center blade segment and each end blade segment, and wherein a bottom edge and a bottom portion of the front face of each center blade segment and each end blade segment is exposed and visible for inspection.

15. The plow blade of claim 14, wherein the top portion of the front face of each center blade segment and each end blade segment is recessed relative to the bottom portion of the front face to provide a substantially smooth transition between the encased top portion and the exposed bottom portion of the front face.

16. The plow blade of claim 14, wherein the top portion of each center blade segment and each end blade segment comprises at least one opening, and wherein the elastomeric portion is disposed in the at least one opening to hold the blade segment in position and secured within the elastomeric portion.

17. The plow blade of claim 1, wherein the plow blade is configured to be removably attached to a second plow blade.

18. The plow blade of claim 1, wherein the one or more blade segments are at least partially embedded in the elastomeric portion.

19. A plow, comprising:

a moldboard;

a plow blade removably attached to the moldboard, the plow blade comprising: one or more blade segments; an elastomeric portion that at least partially surrounds the one or more blade segments and permits the one or more blade segments to move relative to the moldboard when the plow blade is attached to the moldboard; and one or more bushings disposed in the elastomeric portion for attaching the plow blade to the adapter blade, wherein the one or more blade segments are shaped and positioned within the elastomeric portion such that at least one vertical side of each blade segment comprises a recessed portion that at least partially surrounds at least one bushing of the plow blade; and at least one fastener extending through the one or more bushings of the plow blade and the at least one opening in the adapter blade to mount the plow blade to the moldboard.

20. The plow of claim 19, wherein the portion of each blade segment contacts at least one bushing if the blade segment moves downward a certain distance.

21. The plow of claim 19, wherein the recessed portion comprises a first section that is at least partially positioned between the bushing and the top edge of the plow blade.

22. The plow of claim 21, wherein the recessed portion comprises a second section that is at least partially positioned between the bushing and a bottom edge of the plow blade.

23. The plow of claim 19, wherein the recessed portion is at least partially curved.

24. The plow of claim 19, wherein the recessed portion forms a protruding end of the blade segment that is disposed between the bushing and the top edge of the plow blade.

25. The plow of claim 19, wherein the one or more blade segments are at least partially embedded in the elastomeric portion.

26. The plow of claim 19 further comprising an adapter blade attached to the moldboard, wherein the plow blade is removably attached to the adapter blade.

27. A method of installing a plow blade to a plow moldboard, comprising the steps of:

utilizing a plow blade comprising: one or more blade segments; an elastomeric portion that at least partially surrounds the one or more blade segments and permits the one or more blade segments to move relative to the moldboard when the plow blade is attached to the moldboard; and one or more bushings disposed in the elastomeric portion for attaching the plow blade to the moldboard, wherein the one or more blade segments are shaped and positioned within the elastomeric portion such that at least one vertical side of each blade segment comprises a recessed portion that at least partially surrounds at least one bushing of the plow blade;

aligning the one or more bushings of the plow blade with the one or more openings of the moldboard; and inserting one or more fasteners through the one or more bushings of the plow blade and the one or more openings of the moldboard to attach the plow blade to the moldboard.

28. The method of claim 27 further comprising aligning one or more openings of a mounting member with the one or more bushings of the plow blade and inserting one or more fasteners through the one or more openings of the mounting member.

29. The method of claim 27, wherein the one or more blade segments of the plow blade are at least partially embedded in the elastomeric portion.

30. The method of claim 27 further comprising utilizing an adapter blade comprising one or more openings, aligning the one or more openings of the adapter blade with the one or more openings of the moldboard, inserting one or more fasteners through the one or more openings of the adapter blade and the one or more openings in the moldboard to attach the adapter blade to the moldboard, aligning the one or more bushings of the plow blade with the one or more openings of the adapter blade, and inserting one or more fasteners through the one or more bushings of the plow blade and the one or more openings of the adapter blade to attach the plow blade to the adapter blade.

* * * * *